US005926144A

United States Patent [19]

Bolanos et al.

[11] Patent Number: 5,926,144

[45] Date of Patent: Jul. 20, 1999

[54] WEARABLE ELECTRONIC DEVICE AND ANTENNA THEREFOR

[75] Inventors: Angel M. Bolanos, Coral Springs, Fla.; Davar Parvin, Southington, Conn.

[73] Assignee: Motorola, Inc., Schaumburg, Ill.

[21] Appl. No.: 09/046,202

[22] Filed: Mar. 23, 1998

[51] Int. Cl.[6] ..... H01Q 1/12; G04B 47/00

[52] U.S. Cl. ..... 343/718; 368/10; 343/866

[58] Field of Search ..... 343/718, 748, 343/866; 368/10; H01Q 1/12; G04B 47/00

[56] References Cited

U.S. PATENT DOCUMENTS

| | | | |
|---|---|---|---|
| 4,873,527 | 10/1989 | Tan | 343/718 |
| 4,884,252 | 11/1989 | Teodoridis et al. | 368/10 |
| 5,280,296 | 1/1994 | Tan et al. | 343/718 |
| 5,768,217 | 6/1998 | Sonoda et al. | 368/10 |

*Primary Examiner*—Hoanganh Le
*Assistant Examiner*—Shih-Chao Chen
*Attorney, Agent, or Firm*—Philip P. Macnak

[57] ABSTRACT

An internal antenna (302) for a wearable electronic device (1000) includes first and second elongated conductor segments (416, 418) which are fabricated in a form of an arc to conform substantially to a portion of a substantially circular housing cavity, and first and second shortened conductor segments (420, 422). The first and second elongated conductor segments (416, 418) and the first and second shortened conductor segments (420, 422) are formed into a single turn loop having a rectangular antenna aperture (436). Connection tabs (424) are formed contiguous with, and located symmetrically about, a midpoint of one of the first and second elongated conductor segments (416, 418) and couple the antenna (302) to a receiver (1104) which is located on a circuit substrate (406) which is positioned between the first and second elongated conductor segments (416, 418).

19 Claims, 5 Drawing Sheets

WEARABLE ELECTRONIC DEVICE AND ANTENNA THEREFOR

FIELD OF THE INVENTION

This invention relates in general to antennas, and more specifically to an antenna for use with a wearable electronic device.

BACKGROUND OF THE INVENTION

Various wearable electronic devices, and in particular wrist worn electronic devices utilizing antennas have been offered for sale for many years. How successful these wrist worn electronic devices have been has often been based on how well the antenna utilized performed. Antennas for wrist worn electronic devices have generally come in two types, those antennas located within the wristband, and antennas which can be located somewhere within the housing of the device. The particular choice of antenna type was generally based on frequency of operation, with wrist worn electronic devices operating at lower frequencies, typically below 300–500 Mhz utilizing wristband antennas, and wrist worn electronic devices operating above 300–500 MHz utilizing some form of an internal antenna.

Irrespective of the choice of the type of antenna which has been used in a wrist worn electronic device, the major design problem has always been one of how to maximize the antenna sensitivity and how to minimize the complexity of the interconnection of the antenna to the receiver.

What is needed is an antenna design which can be utilized to maximize the antenna sensitivity when utilized within the housing of a wrist worn electronic device. What is also needed is an antenna design which can effectively couple to the circulating currents generated about the body of the electronic device wearer. And furthermore, what is needed is an antenna design which can be easily changed to provide additional antenna sensitivity when needed.

DESCRIPTION OF THE PREFERRED EMBODIMENTS

Figure 1:
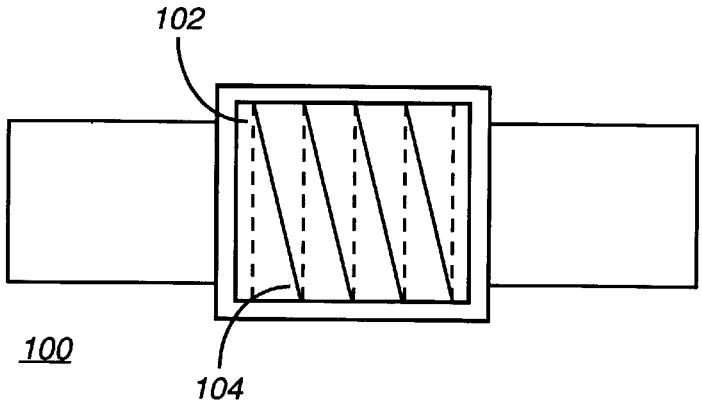
FIG. 1 PRIOR ART
FIG. 1 is a diagram of a prior art wearable electronic device utilizing an internal antenna.
Figure 2:
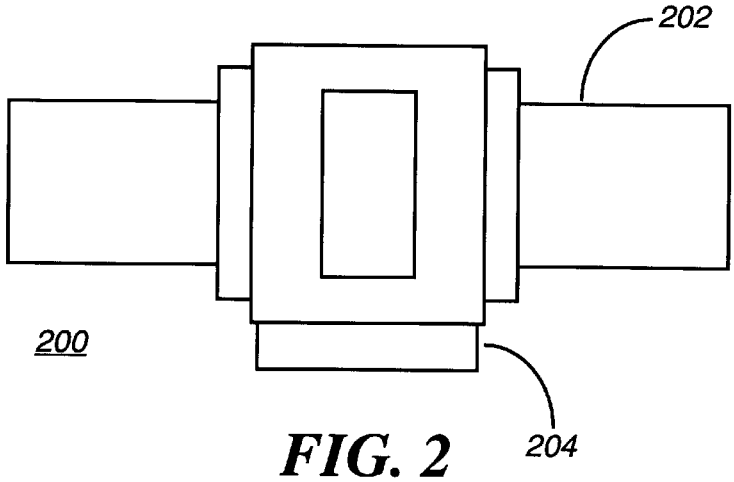
FIG. 2 PRIOR ART
FIG. 2 is a diagram of a prior art wearable electronic device utilizing a wristband antenna and an internal antenna.

Prior art wearable electronic devices, such as wrist worn electronic devices as shown in FIGS. 1 and 2, are typical of a watch and pager combination, often referred to as a pager-watch or watch pager. In particular, FIG. 1 is a diagram of a prior art wearable electronic device, a wrist worn electronic device 100, which utilized an internal antenna which was formed from a multi-turn loop antenna having antenna elements 102 formed from metallic wire sunk into the back cover of the wrist worn electronic device housing, and upper antenna elements 104 formed by metallization deposited on the back surface of the face plate which were connected by elastomeric interconnects.

Such an antenna as shown in FIG. 1 added considerably to the complexity to fabricating the back cover, the watch face plate, and to the overall assembly of the wrist worn electronic device. Because the loop antenna enveloped the receiver components, interactions between the receiver components and the antenna were likely to reduce the ultimate antenna sensitivity obtainable. Furthermore, because of the numerous interconnections between antenna elements, resistive losses would be expected to further reduce the ultimate receiver sensitivity obtainable.

FIG. 2 is a diagram of another prior art wearable electronic device, a wrist worn electronic device 200, which utilized a wristband antenna 202 in combination with an internal antenna 204. The combination of the wrist band antenna and the internal antenna optimized the antenna sensitivity over the various positions the wrist worn device would assume, as the arm of the user was moved. However, the combination also added complexity to the assembly of the wrist worn electronic device 200, and was limited to operation at lower operating frequencies, typically below 200 to 300 MHz (megahertz).

The antenna for the wearable electronic device in accordance with the present invention resolves many of the problems highlighted in the prior art wrist worn electronic devices described above. As will be described below, the antenna of the wearable electronic device in accordance with the present invention reduces the complexity of assembly, reduces the interaction of the antenna with the receiver elements, couples effectively to the circulating currents present on the body of the user, is suitable for use at higher operating frequencies, and can be easily implemented to optimize the antenna efficiency as needed as will be described below.

Figure 3:
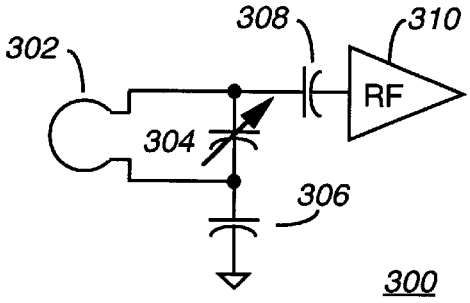
FIG. 3 is an electrical schematic diagram of an antenna for a wearable device in accordance with the present invention.

FIG. 3 is an electrical schematic diagram of an antenna for a wearable electronic device in accordance with the present invention. As shown, the internal antenna 302 has one output terminal coupled to the junction of a capacitor 304 and a capacitor 306. The second terminal of capacitor 306 is coupled to ground. The second terminal of capacitor 304 is coupled to the second terminal of internal antenna 302 and to a first terminal of capacitor 308. The second terminal of capacitor 308 is coupled to the input of an RF (radio frequency) amplifier 310. Capacitor 304 is adjustable and is used to tune the internal antenna 302. Capacitor 306 provides direct current (d.c.) isolation for the internal antenna 302 from ground, which minimizes interactions between the internal antenna 302 and the body of the user which degrade antenna performance. Capacitor 308 provides the match between the tuned antenna and the input of the RF amplifier 310. It will be appreciated that capacitor 306 and capacitor 308 can be implemented with one or more capacitors in series or parallel when a non-standard capacitance value is required.

Figure 4:
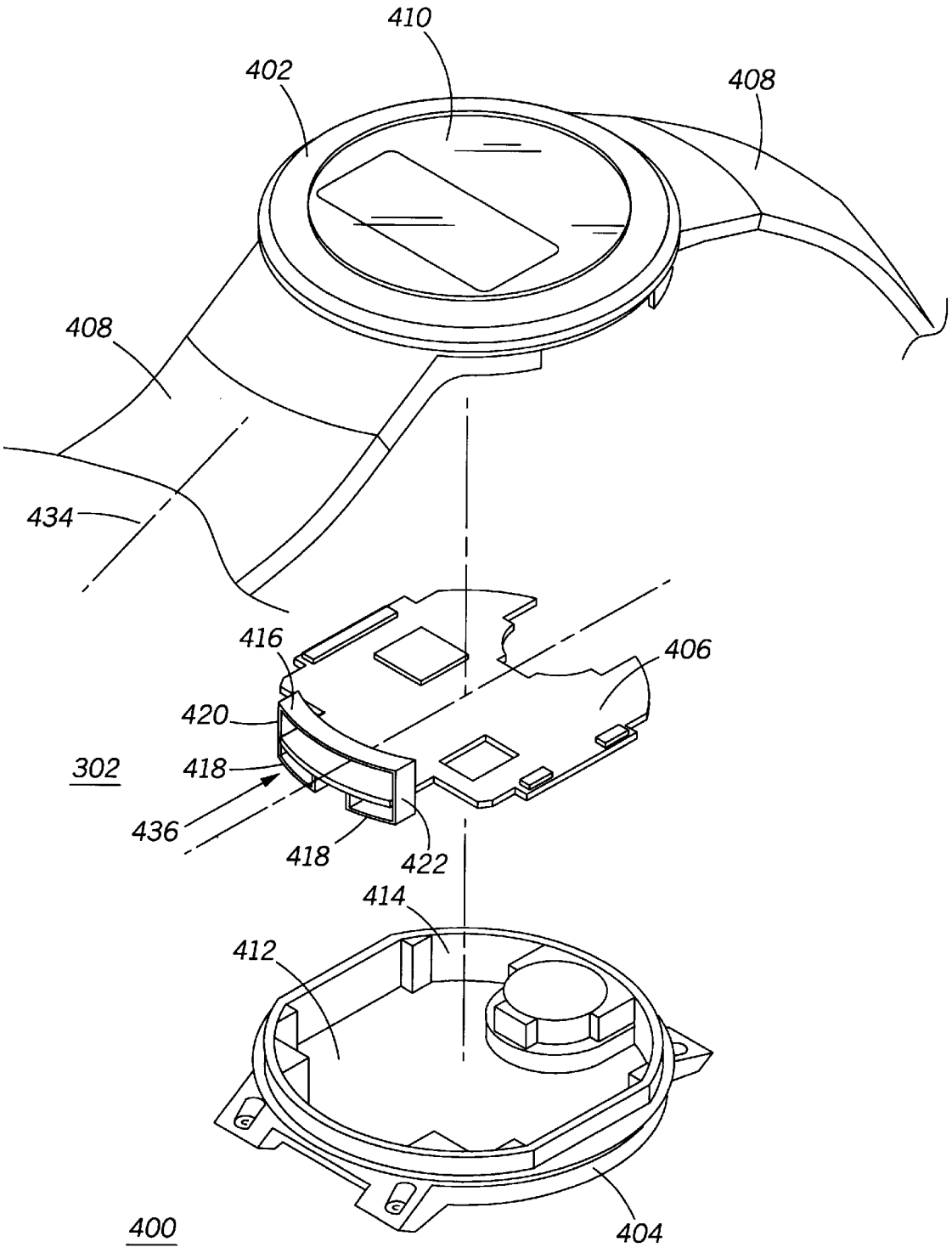
FIG. 4 is an exploded view of a wrist worn electronic device utilizing an internal antenna in accordance with a preferred embodiment present invention.

FIG. 4 is an exploded view of a wearable electronic device, such as a wrist worn electronic device 400, utilizing the internal antenna 302 in accordance with a preferred embodiment of the present invention. The wearable electronic device in accordance with the preferred embodiment of the present invention is best exemplified as a watch pager, although it will be appreciated that other wearable electronic devices, such as a wearable pendant style communication device, can utilize the internal antenna in accordance with the present invention. The watch pager includes and upper housing 402, a lower housing 404, a circuit substrate 406, a wrist band 408 and a face plate 410. The lower housing 404 has generally a circular shape externally and includes a cavity which has a side wall 414 which defines a substantially circular cavity 412 in which the circuit substrate 406 is retained. While only a single circuit substrate is shown, it will be appreciated that one or more additional circuit substrates may be required to support additional circuit functions, such as a signaling decoder and a controller which is used to control various time keeping and display functions. The circuit substrate 406 and any additional circuit substrates have a substantially circular outline which conforms to the substantially circular cavity 412 into which the circuit substrates will be placed. The upper housing 402 includes the face plate 410 through which time keeping functions and messages which are received can be viewed. The wrist band 408 is attached to the upper housing 402 and enables the wearable electronic device to be carried on the wrist of a user. A necklace or neck strap would be utilized to enable the wearable electronic device to be carried about the neck of a user.

The internal antenna 302 in accordance with the preferred embodiment of the present invention is a loop antenna comprising a single turn which is formed from a conductor having two elongated sides, a first conductor segment forming an upper elongated side 416 and a second conductor segment forming a lower elongated side 418 and two shortened sides 420, 422 formed by first and second shortened conductor segments which provide a rectangular antenna aperture 436. The two shortened sides 420, 422 have a length which is substantially equal in height to the side wall 414 of the substantially circular cavity 412. The two elongated sides are fabricated in the form of an arc which conforms substantially to the substantially circular cavity 412 of the lower housing 404, as will be described in further detail below. The single turn loop terminates in connection tabs (not shown in FIG. 4) which coupled the single turn loop to the receiver, and which are located symmetrically about the midpoint of one of the elongated sides, in particular, lower elongated side 418 as shown.

The wrist band 408 has an axis 434 which extends circumferentially around the users wrist, and the rectangular antenna aperture 436 projects onto a plane which is perpendicular to the axis 434 of the wrist band 408. In the preferred embodiment of the present invention, the axis 434 of the wrist band bisects the rectangular antenna aperture 436 of the single turn loop, as shown in FIG. 4. This orientation maximizes the coupling of the single turn loop to the currents induced by a radio frequency signal which circulate around the wrist of the device user.

FIGS. 5, 6, 7, and 8 are drawings showing the internal antenna 302 in accordance with the preferred embodiment of the present invention. The internal antenna 302 is formed from a conductor which has a flat cross-section using any of a number of well known metal forming techniques, such as stamping using a die, or etching. The conductor is fabricated from a sheet metal which is typically selected from a groups of sheet metals consisting of beryllium copper, copper, and phosphor bronze which provide both electrical (resistance per unit square) and mechanical characteristics (ductility, tensile strength, hardenability) which are suitable for antenna fabrication. It will be appreciated that other conductive materials can be utilized as well.

Figure 5:
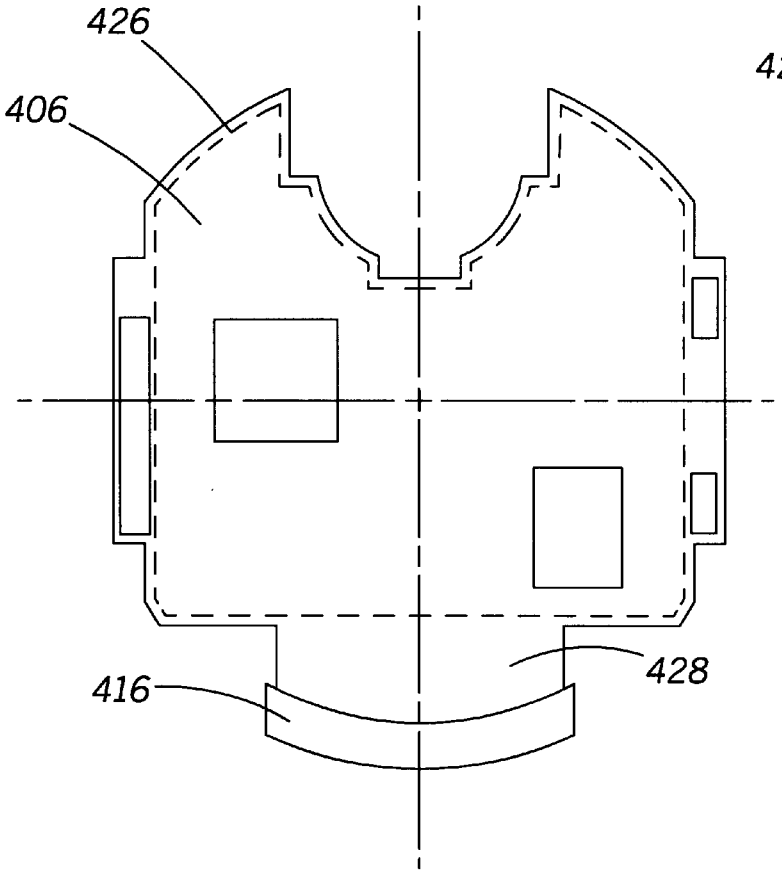
FIGS. 5, 6, 7, and 8 are drawings showing the internal antenna in accordance with the preferred embodiment of the present invention.
Figure 6:
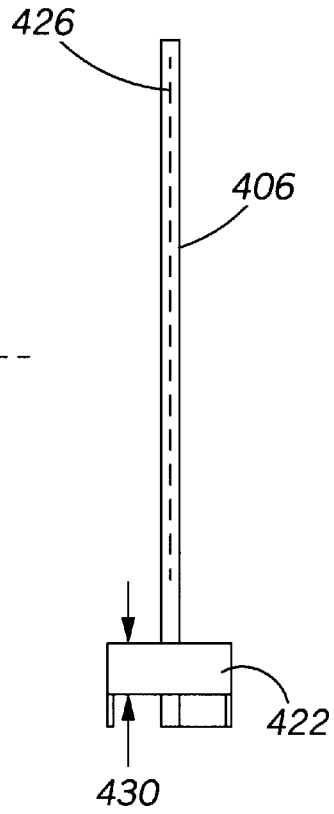

As shown in FIGS. 5 and 6, the circuit substrate 406 can include an internal ground plane 426 which shields electrical signals generated by electrical circuits present on one side of the circuit substrate 406 from interfering signals generated by electrical circuits present on the other side of the circuit substrate 406, and also attenuates interfering signals which are generated by the electrical circuits present on the circuit substrate 406, thereby maximizing the performance of the internal antenna 302. The internal ground plane 426 is formed as a separate internal layer of a multi-layer printed circuit board. By minimizing the interfering signals, the performance of the single turn loop is also maximized. The single turn loop is also isolated from components and electrical conductors formed on the circuit substrate 406 by a distance 428. The distance 428 can be determined empirically, and minimizes dequeing of the internal antenna 302.

In order to minimize the resistance of the single turn loop, the width 430 of the conductor is substantially greater than the thickness 432, and the width 430 of the conductor forming the upper elongated side 416 and the lower elongated side 418 which are perpendicular to the side wall 414 of the substantially circular cavity 412, which insures the effective antenna aperture is maximized.

Figure 7:
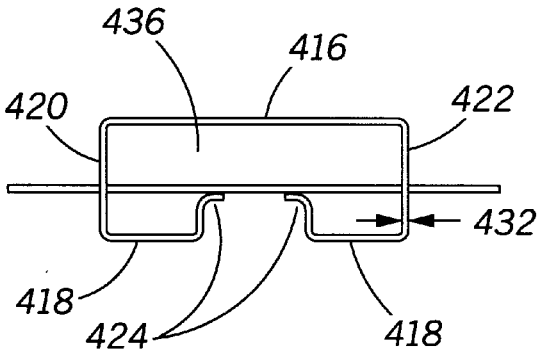

As shown in FIG. 7, the single turn loop is supported by the circuit substrate 406 by way of connection tabs 424 which are formed contiguous with, and located symmetrically about, a midpoint of one of the elongated conductor segments forming elongated side 418 to provide both mechanical and electrical connection to the circuit substrate 406 by way of soldering or other suitable electromechanical bonding technique. The circuit substrate 406 is also positioned between upper elongated side 416 and the lower elongated side 418 so as to allow components to be placed on both sides of the circuit substrate 406. So as to minimize interaction with any components which are mounted on the circuit substrate 406, the upper elongated side 416 is preferably positioned at least 1.8 millimeters from upper surface of the circuit substrate 406 at an operating frequency of 930 MHz. It will be appreciated that many factors contribute to determining this distance, not the least of which is the frequency of operation of the receiver.

Figure 8:
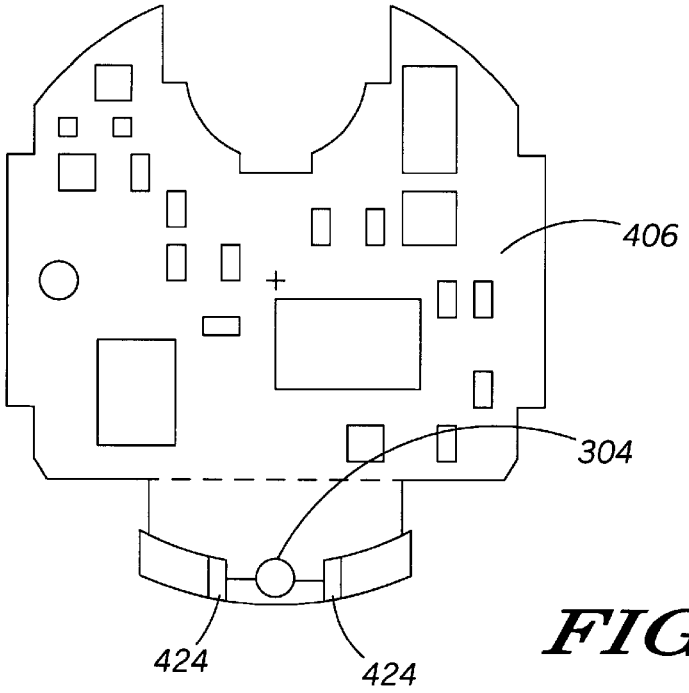

As shown in FIG. 8, the antenna tuning capacitor 304 is preferably mounted on the circuit substrate 406 in an area between the connection tabs 424.

Figure 9:
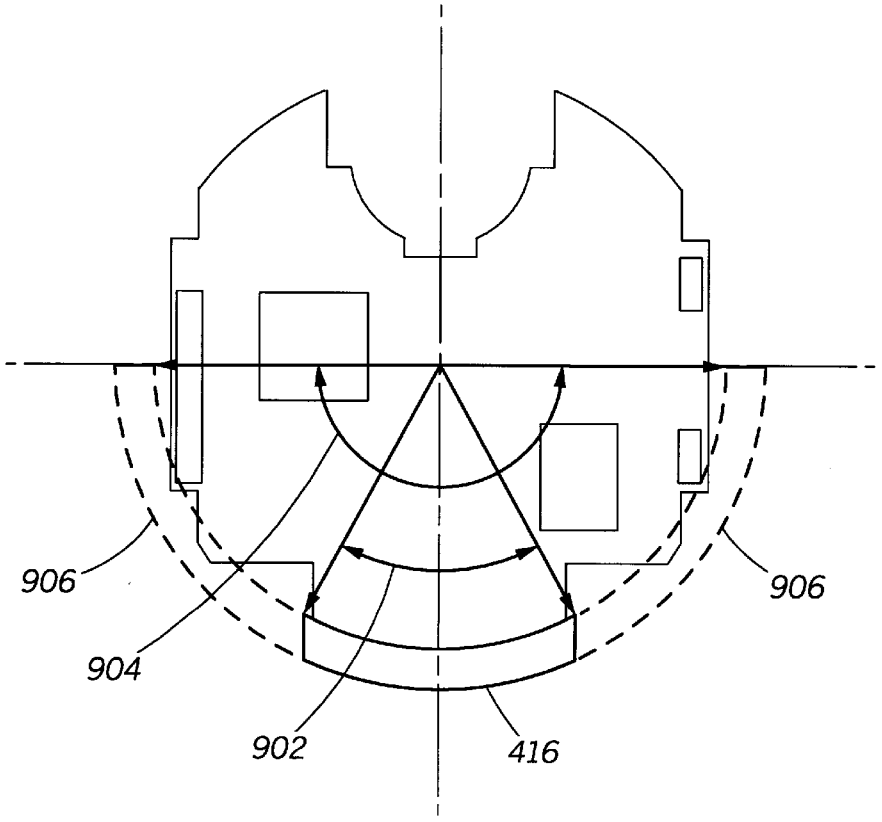
FIG. 9 is a drawing which illustrates the versatility of the internal antenna in accordance with the preferred embodiment of the present invention.

FIG. 9 is a drawing which illustrates the versatility of the internal antenna 302 in accordance with the present invention. In order to maximize the coupling of the single turn loop to the circulating currents which encircle the wrist of the user for a wrist worn electronic device, the rectangular antenna aperture 436 projects onto a plane which is perpendicular to the axis 434 of the wrist band 408 as described above. The two elongated sides 416, 418 preferably have a length which subtends an arc 902 of at least 45°. The effective antenna aperture can be increased when additional antenna sensitivity is required by increasing the upper elongated side 416 and lower elongated side 418 by up to a length 906 which subtends an arc 904 less than or equal to 180°. In this instance, the elongated conductor segments are fabricated in a form of an arc to conform substantially to a portion of a circle, preferably less than or equal to 180°. Because the conductor segments forming the elongated sides are fabricated in the form of an arc which conforms to the substantially circular cavity 412 of the lower housing 404, interaction of the components mounted on the circuit substrate 406 and the conductive runners is minimized which reduces the likelihood of dequeing the internal antenna 302.

Figure 10:
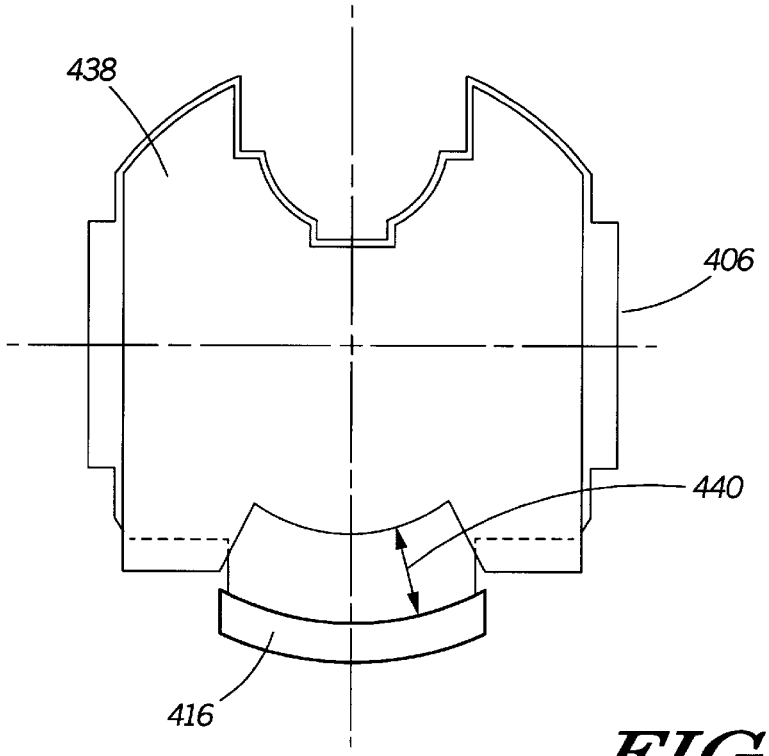
FIG. 10 is a drawing which illustrates the use of a shield with internal antenna in accordance with an alternate embodiment of the present invention.

FIG. 10 is a drawing which illustrates the use of a metal shield 438 with internal antenna 302 in accordance with an alternate embodiment of the present invention. When the wearable electronic device is a watch pager, as will be described below, the receiver components are located on a first circuit substrate, such as circuit substrate 406, and the decoder and watch functions are located on a second circuit substrate. Because the signals generated on the second circuit substrate can desense the receiver, the metal shield 438 is introduced between the first circuit substrate 406 and the second circuit substrate to attenuate the signals. In addition to shielding one circuit substrate from another circuit substrate, the metal shield 438 is often used to provide a common ground for switches utilized in operating the watch and pager functions, as will be described below. While the metal shield 438 is effective in shielding one circuit substrate from another circuit substrate, the proximity of the metal shield 438 to the internal antenna 302 is detrimental, resulting on the dequeing of the internal antenna 302. The dequeing of the internal antenna 302 can be minimized by controlling the distance 440 between the metal shield 438 and the internal antenna. As shown in FIG. 10, the metal shield includes a portion separated from the internal antenna by a predetermined distance 440, and the metal shield 438 is fabricated with an arc which corresponds to arc of the upper elongated side 416 of the internal antenna 302. By fabricating the metal shield 438 in this manner, the degradation of the internal antenna is minimized, which the isolation between the first circuit substrate 406 and the second circuit substrate is maximized.

Figure 11:
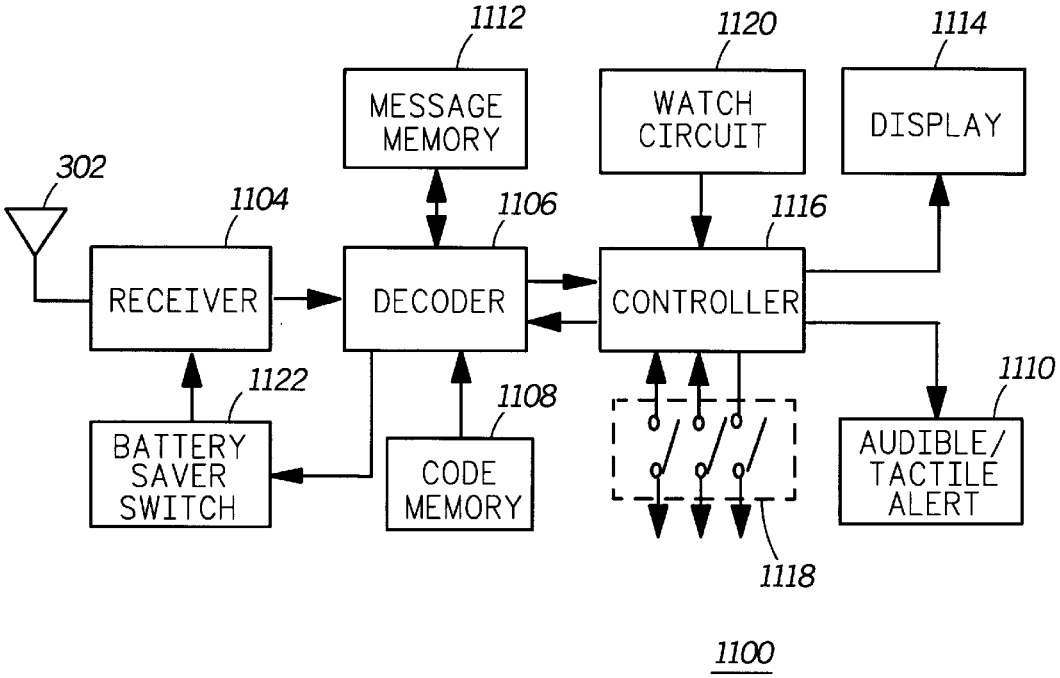
FIG. 11 is an electrical schematic diagram of a wearable electronic device utilizing the internal antenna in accordance with the present invention.

FIG. 11 is an electrical block diagram of a wearable electronic device 1100, such as a watch pager, which utilizes an internal antenna 302 in accordance with the present invention. Radio frequency signals are intercepted by the internal antenna 302 which is coupled to the input of a receiver 1104 which processes the intercepted radio frequency signals, in a manner well known to one of ordinary skill in the art. In practice, the intercepted signals, which represent a selective call message, include address signals identifying the watch pager 1100 to which message signals are intended. The received address signals are coupled to the input of a decoder 1106 which compares the received address signals with a predetermined address which is stored within a code memory 1108. When the received address signals match the predetermined address stored, message signals are received, and the decoder 1106 functions as a message decoder, decoding message signals which are received, to produce message information which is then stored in a message memory 1112. The decoder 1106 generates a control signal which is coupled to a controller 1116 which generates an alert control signal which is coupled to an alerting circuit 1110 which generates an audible/tactile alert, using a transducer to generate an audible alert, and/or a vibrator to generate a tactile alert indicating that a message has been received. The audible/tactile alert is reset by the pager-watch user and the message is recalled from the message memory 1112 for presentation of the message on the display 1114 using switches 1118 to provide a variety of user input functions which are well known to one of ordinary skill in the art. The message recalled from the message memory 1112 is directed via the controller 1116 to a display 1114, such as an LCD display. Time keeping functions are provided by a watch circuit 1120 which provides normal time keeping functions, such as time and date, alarm functions, and other time keeping functions. The time and date are normally displayed on the display 1114, and can be set or changed by the switches 1118. The watch circuit 1120 and controller 1116 can be separate circuits, or can be implemented using a microcomputer to provide both time keeping and pager-watch control functions. The decoder 1106 can be a separate integrated circuit or the decoding functions can also be provided with the use of a microcomputer, as is well known in the art. A battery saver switch 1122 couples to the decoder 1006 and controls the supply of power to the receiver 1104 to provide a well known battery saving function.

In summary, an internal antenna 302 for a wearable electronic device has been described above which maximizes the antenna sensitivity by locating the antenna about the periphery of a substantially circular circuit substrate which, in turn, reduces the interaction of the antenna with components and runners located on the circuit substrate 406. The internal antenna described above effectively couples to the circulating currents generated about the body of the electronic device user, and can be easily changed to vary the antenna sensitivity, when required. A ground plane can placed within an interior layer of the circuit substrate to reduce interaction between signals generated on the circuit substrate and the internal antenna. A metal shield can also be added within the wearable electronic device to minimize the interaction between multiple circuit substrates and the internal antenna. The wearable electronic device can be in the form of a wrist worn electronic device, a pendant style electronic device, or other wearable style electronic device in which the internal antenna couples to currents circulating about the body of the user.

We claim:

1. A wearable electronic device comprising:

a receiver mounted on a circuit substrate which has a substantially circular outline, said circuit substrate being secured into a housing having a side wall which defines a substantially circular cavity; and a loop antenna, comprising:

a conductor formed into a single turn loop comprising two elongated sides and two shortened sides which form a rectangular antenna aperture, wherein said two elongated sides include an upper elongated side and a lower elongated side which are fabricated in a form of an arc which conforms substantially to said substantially circular cavity of said housing, and wherein said circuit substrate is positioned between said upper elongated side and said lower elongated side, and said single turn loop terminating in connection tabs, located symmetrically about a midpoint of one of said two elongated sides, for coupling to the receiver.

2. The wearable electronic device of claim 1, wherein said conductor has a flat cross-section having a width substantially greater than its thickness, and wherein said width of said conductor forming said two elongated sides is perpendicular to the side wall of said substantially circular cavity.

3. The wearable electronic device of claim 1, wherein the wearable electronic device is attached to a wrist with a wrist band, and the wrist band has an axis which extends circumferentially around the wrist, and wherein said rectangular antenna aperture projects onto a plane which is perpendicular to the axis of the wrist band.

4. The wearable electronic device of claim 3, wherein said wrist band axis bisects said rectangular antenna aperture of said single turn loop.

5. The wearable electronic device of claim 1, wherein said two elongated sides have a length which subtends an arc of at least 45°.

6. The wearable electronic device of claim 1, wherein said two elongated sides have a length which subtends an arc less than or equal to 180°.

7. The wearable electronic device of claim 1, wherein said two shortened sides have a length which is substantially equal in height to said side wall of said substantially circular cavity.

8. The wearable electronic device of claim 1, wherein said upper elongated side is positioned at least 1.8 millimeters from said circuit substrate.

9. The wearable electronic device of claim 1, wherein said conductor is fabricated from a sheet metal which is selected from a groups of sheet metals consisting of beryllium copper, copper, and phosphor bronze.

10. The wearable electronic device of claim 1, wherein said single turn loop is direct current isolated from ground.

11. The wearable electronic device according to claim 1, further comprising a metal shield which isolates said circuit substrate from a second circuit substrate, and wherein said metal shield includes a portion separated from said loop antenna by a predetermined distance, wherein said portion of said metal shield is fabricated with an arc which corresponds to said arc of said upper elongated side of said loop antenna.

12. The wearable electronic device of claim 1 wherein said circuit substrate includes an internal ground plane which attenuates interfering signals which are generated by electrical circuits present on said circuit substrate, thereby maximizing performance of said loop antenna.

13. The wearable electronic device of claim 1, further comprising:

a watch circuit for generating watch functions; and a display for displaying the watch functions generated.

14. The wearable electronic device of claim 1, wherein said single turn loop intercepts selective call signals, and wherein the electronic device further comprises:

a decoder, coupled to said receiver, for decoding the selective call signals, and for generating a control signal when the selective call signals match a predetermined address stored within the electronic device; and an alerting circuit for generating an alert in response to the control signal being generated.

15. The wearable electronic device of claim 14, wherein said single turn loop further intercepts message signals, and wherein the electronic device further comprises:

message decoder, for decoding the message signals to recover a message in response to the control signal being generated; and a display for displaying the message.

16. An internal antenna for a wearable electronic device, comprising:

first and second elongated conductor segments which are fabricated in a form of an arc to conform substantially to a portion of a circle;

first and second shortened conductor segments, said first and second elongated conductor segments and said first and second shortened conductor segments being formed into a single turn loop having a rectangular antenna aperture; and connection tabs, formed contiguous with and located symmetrically about a midpoint of one of said first and second elongated conductor segments, for coupling the antenna to a receiver which is located on a circuit substrate which is positioned between said first elongated conductor segment and said second elongated conductor segment.

17. The internal antenna of claim 16, wherein said first and second elongated conductor segments have a length which subtends an arc of at least 45°.

18. The internal antenna of claim 16, wherein said first and second elongated conductor segments have a length which subtends an arc less than or equal to 180°.

19. The internal antenna of claim 16, wherein said first and second elongated conductor segments and said first and second shortened conductor segments are formed from sheet metal which is selected from a groups of sheet metals consisting of beryllium copper, copper, and phosphor bronze.

* * * * *